US011742570B2

(12) United States Patent
Yoon et al.

(10) Patent No.: US 11,742,570 B2
(45) **Date of Patent: *Aug. 29, 2023**

(54) MEANDER LINE SLOTS FOR MUTUAL COUPLING REDUCTION

(71) Applicant: University of Florida Research Foundation, Inc., Gainesville, FL (US)

(72) Inventors: Yong-Kyu Yoon, Gainesville, FL (US); Seahee Hwangbo, Gainesville, FL (US)

(73) Assignee: UNIVERSITY OF FLORIDA RESEARCH FOUNDATION, INC., Gainesville, FL (US)

( * ) Notice: Subject to any disclaimer, the term of this patent is extended or adjusted under 35 U.S.C. 154(b) by 46 days.

This patent is subject to a terminal disclaimer.

(21) Appl. No.: 17/315,964

(22) Filed: May 10, 2021

(65) Prior Publication Data

US 2022/0021110 A1 Jan. 20, 2022

Related U.S. Application Data

(63) Continuation of application No. 16/310,294, filed as application No. PCT/US2017/037724 on Jun. 15, 2017, now Pat. No. 11,005,174.

(Continued)

(51) Int. Cl.
*H01Q 1/52* (2006.01)
*H01Q 21/06* (2006.01)

(Continued)

(52) U.S. Cl.
CPC ..... *H01Q 1/523* (2013.01); *H01Q 1/52* (2013.01); *H01Q 3/00* (2013.01); *H01Q 9/04* (2013.01);

(Continued)

(58) Field of Classification Search
CPC ..... H01Q 1/523; H01Q 1/52; H01Q 21/065; H01Q 21/06; H01Q 3/00; H01Q 9/0407; H01Q 9/04

(Continued)

(56) References Cited

U.S. PATENT DOCUMENTS 7,423,593 B2 * 9/2008 Puente Baliarda .... H01Q 5/378 343/700 MS
10,135,135 B2 * 11/2018 Huang ..... G01S 13/931

(Continued)

OTHER PUBLICATIONS

International Search Report dated Sep. 6, 2017.

(Continued)

*Primary Examiner* — Hai V Tran
(74) *Attorney, Agent, or Firm* — Thomas | Horstemeyer, LLP

(57) ABSTRACT

Various examples are provided for meander line (ML) slots, which can be used for mutual coupling reduction. In one example, an antenna array includes first and second patch antenna elements disposed on a first side of a substrate, the first and second patch antenna elements separated by a gap. The antenna array can include a meander line (ML) slot formed in a ground plane disposed on a second side of the substrate. A plurality of ML slots can be aligned with the gap between the first and second patch antenna elements. In another example, a method includes forming first and second antenna elements on a first side of a substrate and forming a ML slot in a ground plane disposed on a second side of the substrate aligned with a gap between the first and second antenna elements.

20 Claims, 5 Drawing Sheets

Related U.S. Application Data

(60) Provisional application No. 62/350,442, filed on Jun. 15, 2016.

(51) Int. Cl.
*H01Q 9/04* (2006.01)
*H01Q 3/00* (2006.01)

(52) U.S. Cl.
CPC ..... *H01Q 9/0407* (2013.01); *H01Q 21/06* (2013.01); *H01Q 21/065* (2013.01)

(58) Field of Classification Search
USPC ..... 343/893
See application file for complete search history.

(56) References Cited

U.S. PATENT DOCUMENTS

2001/0048394 A1 12/2001 Apostolos et al.
2004/0196190 A1* 10/2004 Mendolia ..... H01Q 9/0407 343/846
2006/0054710 A1* 3/2006 Forster ..... H01Q 1/52 343/745
2006/0097921 A1* 5/2006 Luk ..... H01Q 9/36 343/700 MS
2008/0204347 A1 8/2008 Alvey et al.
2009/0128446 A1 5/2009 Gummalla et al.
2010/0238079 A1 9/2010 Ayatollahi et al.
2011/0273353 A1 11/2011 Achour et al.
2014/0091970 A1* 4/2014 Yu ..... H01Q 9/0407 343/700 MS
2014/0340857 A1* 11/2014 Hsu ..... H01L 23/5386 174/254

OTHER PUBLICATIONS

Habashi et al. "Mutual Coupling Reduction Between Very Closely Spaced Patch Antennas Using Low-Profile Folded Split-Ring Resonators (FSRRs)". IEEE Antennas and Wireless Propagation Letters, vol. 10, 2011 pp. 862-865.

Yang et al. "Microstrip Antennas Integrated With Electromagnetic Band-Gap (EBG) Structures: A Low Mutual Coupling Design for Array Applications" IEEE Transactions on Antennas and Propagation, vol. 51, No. 10 (Oct. 2003) pp. 2936-2946.

Bait-Suwailam et al. "Mutual Coupling Reduction Between Microstrip Patch Antennas Using Slotted-Complementary Split-Ring Resonators" IEEE Antennas and Wireless Propagation Letters, vol. 9, 2010 pp. 876-878.

* cited by examiner

TOP

BOTTOM

| Year | Approach | Resonant Freq (GHz) | Edge to Edge Spacing | Center to Center Spacing | Improvement in S21 [dB] | Resonant Freq. difference between ports |
|---|---|---|---|---|---|---|
| 2005 | EBG | 9.2 | $< 0.33\lambda_0$ | $< 0.7\lambda_0$ | 16.5 | Not reported |
| 2010 | SCSRR | 4.9 | $0.25\lambda_0$ | $0.5\lambda_0$ | 7 | 100MHz |
| 2011 | FSRR | 5.2 | $0.039\lambda_0$ $=0.08\lambda_g$ | $0.27\lambda_0$ | 40 | 50MHz |
| 2012 | WG-Meta-material | 3.5 | $0.125\lambda_0$ | $0.36\lambda_0$ | 6 - 20 | Not reported |
| 2013 | Slotted Meander Line | 4.8 | $0.11\lambda_0$ | $0.38\lambda_0$ | 6 - 16 | Not reported |
| The Proposed Meander-line Slot | | 4.96 | $0.032\lambda_0$ $=0.06\lambda_g$ | $0.25\lambda_0$ | 23-40 | 0MHz (No Freq. Shift) |

FIG. 7

MEANDER LINE SLOTS FOR MUTUAL COUPLING REDUCTION

CROSS REFERENCE TO RELATED APPLICATIONS

This application is a continuation application that claims priority to, and the benefit of, co-pending U.S. non-provisional application entitled "Point Symmetric Complementary Meander Line Slots for Mutual Coupling Reduction" having Ser. No. 16/310,294, filed Dec. 14, 2018, which is the 35 U.S.C § 371 national stage application of PCT Application No. PCT/US2017/037724, filed Jun. 15, 2017, which claims priority to, and the benefit of, U.S. provisional application entitled "Point Symmetric Complementary Meander Line Slots for Mutual Coupling Reduction" having Ser. No. 62/350,442, filed Jun. 15, 2016, all of which are hereby incorporated by reference in their entireties.

STATEMENT REGARDING FEDERALLY SPONSORED RESEARCH OR DEVELOPMENT

This invention was made with government support under grant number 1439644 awarded by the National Science Foundation. The government has certain rights in the invention.

BACKGROUND

Microstrip patch antennas are well known for their performance, robust design, fabrication and their extent usage. Their applications include various fields such as medical, satellites, military systems, aircrafts, missiles etc. The use of microstrip antennas continue to spread due to their low cost. In some applications where high gain is required and area is a constraint, the dimensions of antenna and the number of antennas used play a crucial role. When more than one antenna is used, each radiating element will affect the gain of other antenna because of mutual coupling. The effect increases as the distance between the radiating elements is reduced. This reduces the overall gain of the system.

SUMMARY

Various aspects of the present disclosure are related to point symmetric complementary meander line (PSC-ML) slots, which can be used for mutual coupling reduction. The PSC-ML slots can be utilized in various applications such as, e.g., antenna arrays.

In one aspect, among others, an antenna array comprises first and second patch antenna elements disposed on a first side of a substrate, the first and second patch antenna elements separated by a gap; and point symmetric complementary meander line (PSC-ML) slots formed in a ground plane disposed on a second side of the substrate, the PSC-ML slots comprising a pair of meander line (ML) slots aligned with the gap between the first and second patch antenna elements. In one or more aspects, a gap distance between the first and second patch antenna elements can be less than $0.1\lambda_g$, where $\lambda_g$ is a guided wavelength of the excitation frequency of the antenna array. The pair of ML slots can be disposed with mirrored symmetry about a symmetry point of the gap. The symmetry point can be located at a midpoint of the gap between the first and second patch antenna elements.

In various aspects, each of the pair of ML slots can comprise meander lines extending from opposite ends of that ML slot towards a center point of that ML slot, the meander lines are separated by a fixed distance. Each of the pair of ML slots can comprise two multiply folded sections extending from opposite ends of that ML slot towards a center point of that ML slot, wherein distal ends of the two multiply folded sections are separated by a fixed distance. The antenna array can comprise a tunable capacitor between the distal ends of the two multiply folded sections. In some aspects, the opposite ends of the two multiply folded sections can be connected by a linear section extending between the opposite ends of the ML slot. A length of the PSC-ML slots can be greater than a length of the gap.

In one or more aspects, the antenna array can comprise a plurality of patch antenna elements including the first and second patch antenna elements; and a plurality of PCS-ML slots disposed between adjacent patch antenna elements of the plurality of patch antenna elements. The antenna array can be a microstrip patch antenna comprising N patch antenna elements and N−1 PCS-ML slots. In various aspects, at least one patch antenna element of the plurality of patch antenna elements can have PCS-ML slots disposed along two adjacent sides of the at least one patch antenna element. The antenna array can be an N×M antenna array comprising the plurality of patch antenna elements. N can equal M. In some aspects, at least one patch antenna element of the plurality of patch antenna elements can have PCS-ML slots disposed along four sides of the at least one patch antenna element.

In another aspect, a method comprises forming first and second antenna elements on a first side of a substrate, the first and second antenna elements separated by a gap; and forming point symmetric complementary meander line (PSC-ML) slots in a ground plane disposed on a second side of the substrate, the PSC-ML slots aligned with the gap between the first and second antenna elements. In one or more aspects, forming the PSC-ML slots in the ground plane can comprise disposing the ground plane on the second side of the substrate by electroplating; and forming the PSC-ML slots in the ground plane by etching. The method can further comprise patterning photoresist on the second side of the substrate prior to disposing the ground plane, the patterned photoresist defining the PSC-ML slots. The method can comprise forming a third antenna element on the first side of the substrate, the third antenna element separated from the second antenna element by a second gap; and forming PSC-ML slots in the ground plane that are aligned with the second gap between the third and second antenna elements. The method can comprise forming a fourth antenna element on the first side of the substrate, the fourth antenna element separated from the first antenna element by a third gap and separated from the third antenna element by a fourth gap; and forming PSC-ML slots in the ground plane that are aligned with the third gap between the fourth and first antenna elements and that are aligned with the fourth gap between the fourth and third antenna elements.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 7 is a table comparing performance of the antenna array with PSC-ML slots of FIGS. 4A and 4B with other mutual coupling mitigation methods, in accordance with various embodiments of the present disclosure.

DETAILED DESCRIPTION

Figure 1A:
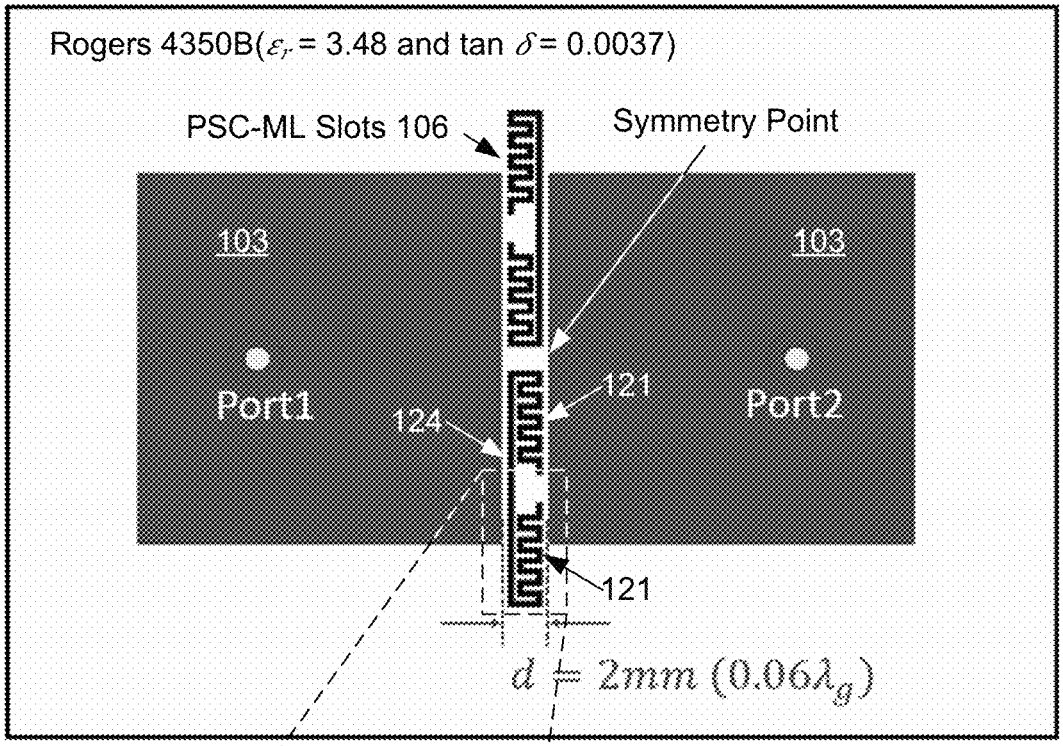
FIGS. 1A and 1B illustrate an example of a 2×1 antenna array comprising point symmetric complementary meander line (PSC-ML) slots, in accordance with various embodiments of the present disclosure.

Disclosed herein are various embodiments of methods related to point symmetric complementary meander line (PSC-ML) slots for mutual coupling reduction. Reference will now be made in detail to the description of the embodiments as illustrated in the drawings, wherein like reference numbers indicate like parts throughout the several views.

Other complementary ML slots have been reported using various decoupling structures such as an EM band-gap (EBG) structure or a Ground Defected Structure (GDS). In "Microstrip antennas integrated with electromagnetic band-gap (EBG) structures: A low mutual coupling design for array applications" by Yang et al., an isolation improvement of 10 dB was achieved by inserting mushroom type EBG structures between 2×1 array antenna elements. However, it contains fabrication complexity due to the vias connecting the top patch and the ground plane in the mushroom type structure. In "Mutual Coupling Reduction Between Microstrip Patch Antennas Using Slotted-Complementary Split-Ring Resonators" by Bait-Suwailam and "Mutual Coupling Reduction Between Very Closely Spaced Patch Antennas Using Low-Profile Folded Split-Ring Resonators (FSRRs)" by Habashi, an isolation improvement of 7 dB and 40 dB have been obtained, respectively. However, a large resonant frequency mismatch between S11 and S22 of 100 MHz and 50 MHz have been caused by asymmetric structures, degrading antenna radiation patterns and efficiency.

In this disclosure, in order to not only achieve high isolation improvement but also remove the resonant frequency mismatch between S11 and S22, a pair of micro-machined meander line (ML) slots have been placed in a complementary point symmetric fashion on the ground plane. The pair of ML slots suppress mutual coupling between two narrowly spaced patches without any resonant frequency mismatch. Such symmetric structures are suitable for array antenna miniaturization with high antenna gain and efficiency.

Point symmetric complementary meander line (PSC-ML) slots can be utilized for mutual coupling reduction between closely placed antenna elements, realizing compact array antennas while maintaining high antenna gain and efficiency. Referring to FIG. 1A, shown is a schematic diagram illustrating an example of a 2×1 antenna array with the two elements (or patches) 103 positioned close together, however these concepts can be applied to any N×M antenna array. In the example of FIG. 1A, the two antenna elements 103 are separated by 2 mm with two micro-fabricated mirror symmetric meander line slots 106 located between the elements 103 and extending in opposite directions about a symmetry point. The PSC-ML unit cell 106 is designed in the ground plane between the neighboring array antenna elements 103 and serves as a band-stop filter that suppresses surface currents and mutual coupling, resulting in good isolation between the antenna elements 103. In other embodiments, the antenna array can be a microstrip patch antenna comprising N patch antenna elements 103 separated by N−1 PCS-ML unit cells.

Figure 1B:
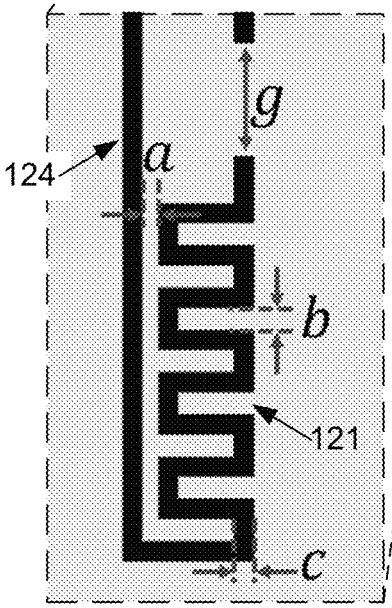

In order to reduce the space between two antenna elements 103, the PSC-ML slots 106 are multiply folded and completely fit in the space between the elements 103. As illustrated in FIG. 1A, each meander line slot 106 includes two multiply folded sections 121 that are connected by a linear section 124 that extends the length of the meander line. The distal ends of the multiply folded sections 121 are separated by a gap or space. The two meander line slots 106 are mirror symmetric about the symmetry point. FIG. 1B is an expanded view of a portion of the ML slots 106 with dimensions of a=0.16 mm (the spacing between the multiply folded sections 121 and the linear section 124), b=0.25 mm (the separation between the folds or turns of the multiply folded sections 121), c=0.21 mm (the linewidth (or slot width) of the meander line slot 106), and g=1.18 mm (the gap between distal ends of the multiply folded sections 121).

The dimensions of the linewidth (c) and the gap or space (g) can be further scaled down by using more advanced microfabrication processes such as e-beam lithography or focused ion beam lithography, etc. Sub micrometer linewidth and gap dimensions are feasible. The overall width of the PSC-ML slots 106 can be as small as a micrometer or less. The typical ratio of the PSC-ML overall width to the gap distance can be in a range from about 1:1 to about 100:1. The distance between the two PSC-ML slots at the symmetry point can be from a few hundred nanometers to a few millimeters (e.g., about 200 nm, 300 nm or 400 nm to about 3 mm, 5 mm or 10 mm). The number of the meander turns can be increased to further reduce the slot size. Using an asymmetric structure comprising a single ML slot can cause a resonant frequency mismatch between return losses of element 1 (S11) and element 2 (S22), which ultimately degrades the antenna radiation patterns. However, using a symmetric ML slot 106 in a complementary point symmetric fashion (in the PSC-ML structure) does not exhibit such resonant frequency mismatch, while preserving the enhancement of antenna gain and efficiency.

As illustrated in FIG. 1A, the pair of PSC-ML slots 106 can extend beyond the edges of the antenna elements 103. In some implementations, the length of the pair of PSC-ML slots 106 can correspond to the size of the antenna elements 103. This can allow for PSC-ML slots 106 to be located on multiple sides of an antenna element 103. For example, in the case of an N×M antenna array, PSC-ML slots 106 can be formed in the ground plane between adjacent antenna elements 103. Depending on the dimensions of the antenna array, PSC-ML slots 106 can be located on one, two, three or four sides of a rectangular antenna element 103. For instance, a 3×3 antenna array can include antenna elements 103 with PSC-ML slots 106 on four sides (center element), three sides (side elements) and two sides (corner elements). The PSC-ML slots 106 can also be utilized with other antenna shapes (e.g., hexagon).

Figure 2:
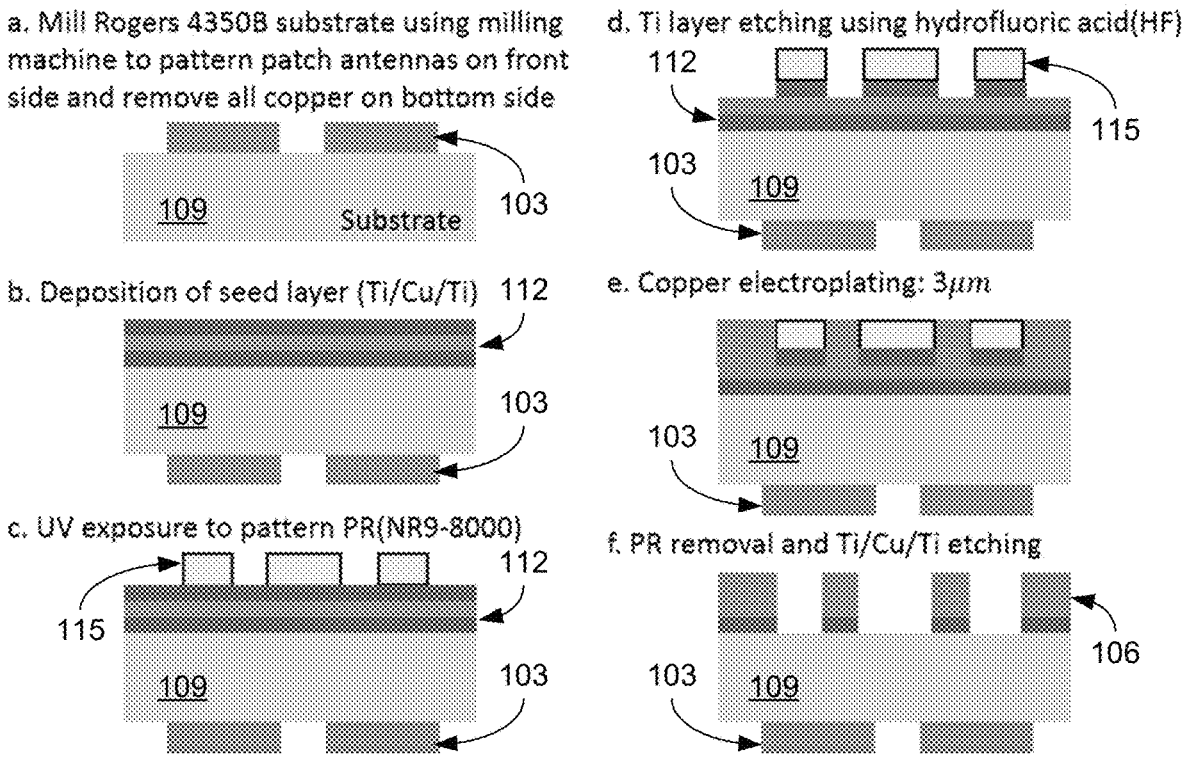
FIG. 2 illustrates an example of a fabrication process for the antenna array with PSC-ML slots of FIGS. 1A and 1B, in accordance with various embodiments of the present disclosure.
Figure 3:
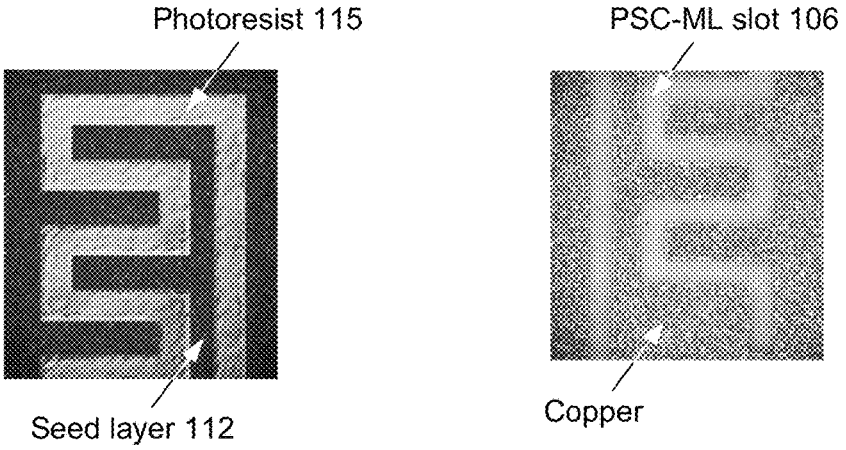
FIG. 3 includes images that illustrate the fabrication of the PSC-ML slots of FIGS. 1A and 1B, in accordance with various embodiments of the present disclosure.
Figure 4A:
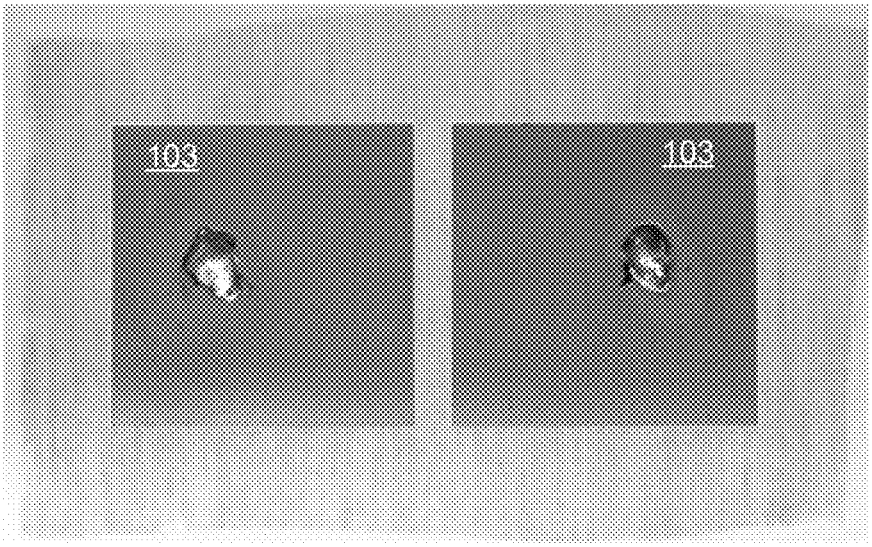
FIGS. 4A and 4B are images of the top and bottom sides, respectively, of the fabricated antenna array of FIGS. 4A and 4B, in accordance with various embodiments of the present disclosure.
Figure 4B:
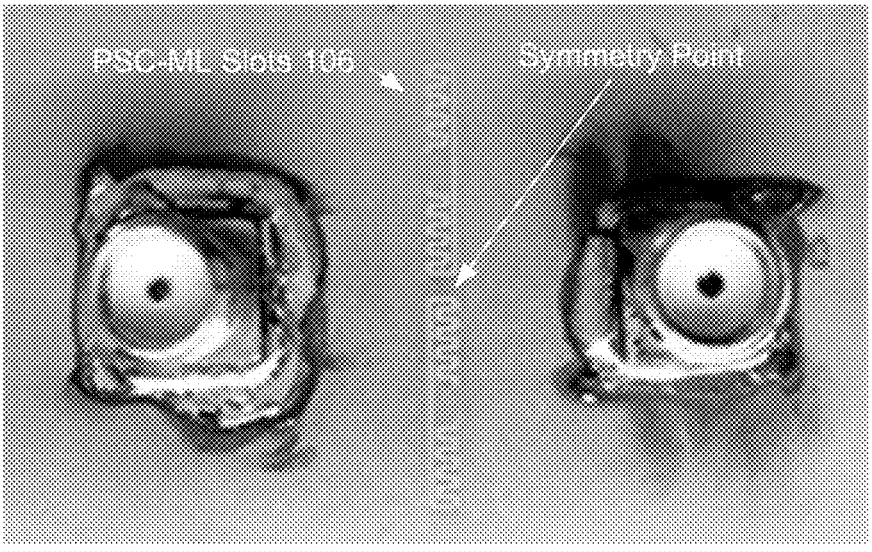

Proof of concept PSC-ML slots 106 were fabricated using microfabrication techniques such as photolithography and electrodeposition, where the smallest dimension of the slot was 210 μm. FIG. 2 illustrates an example of the fabrication of the antenna assembly with PSC-ML slots 106. Beginning with diagram (a) of FIG. 2, patch antenna elements 103 are formed on the front side of a substrate 109 (e.g., a Rogers 4350B substrate). A milling machine can be used to pattern the antenna elements 103 on the top side of the substrate 109 and remove all copper from the bottom side. In diagram (b) of FIG. 2, a seed layer 112 (e.g., Ti/Cu/Ti) is deposited on the bottom side of the substrate opposite the patch antenna elements 103. Photoresist (PR) 115 (e.g., NR9-8000) can then be deposited on the seed layer 112 and patterned to generate the PSC-ML slots 106 using ultraviolet (UV) exposure as illustrated in diagram (c) of FIG. 2. The exposed Ti layer of the seed layer 112 can be etched based on the patterned PR 115 in diagram (d) of FIG. 2 using, e.g., hydrofluoric acid (HF). In diagram (e) of FIG. 2, the ground plane can be formed on the bottom side of the substrate 109 by copper electroplating, which fills in around the patterned PR 115. In diagram (f) of FIG. 2, the PR 115 can be removed and the seed layer 112 etched to leave the PSC-ML slots 106 in the ground plane on the bottom side of the substrate 109. FIG. 3 shows images of the PR 115 deposited on the seed layer 112 and the resulting PSC-ML slot 106 after removal of the PR 115 and etching of the seed layer 112. FIGS. 4A and 4B are images of the top and bottom, respectively, of the fabricated 2×1 antenna array with PSC-ML slots 106. As can be seen, the two meander line slots 106 are mirror symmetric about the symmetry point.

Figure 5:
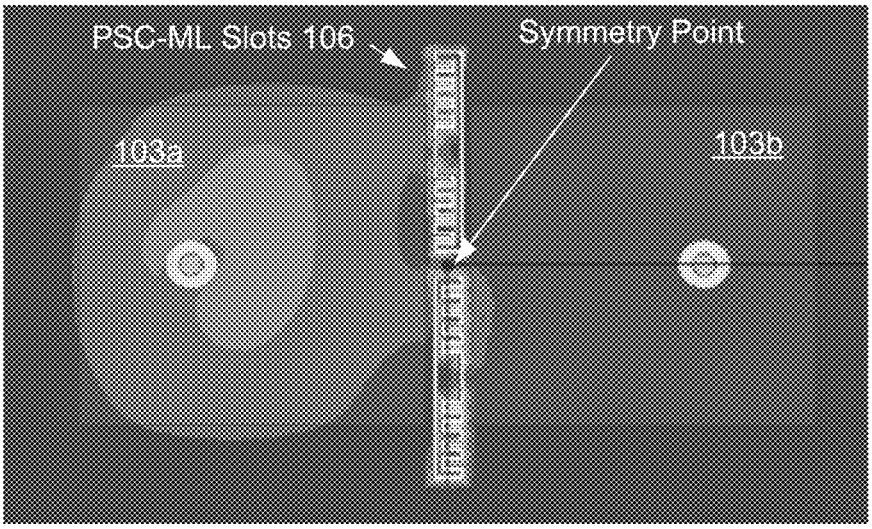
FIG. 5 is a plot illustrating mutual coupling between elements of the antenna array with PSC-ML slots of FIGS. 1A and 1B, in accordance with various embodiments of the present disclosure.

Referring to FIG. 5, shown is a plot illustrating an example of the current distribution produced by exciting a first antenna element 103*a* with the PSC-ML slots 106. As can be seen, there are little or no currents induced in the second (or neighboring) antenna element 103*b* separated by the PSC-ML slots 106, which serve as a band-stop filter that suppresses surface currents and mutual coupling between the separated elements 103.

Figure 6:
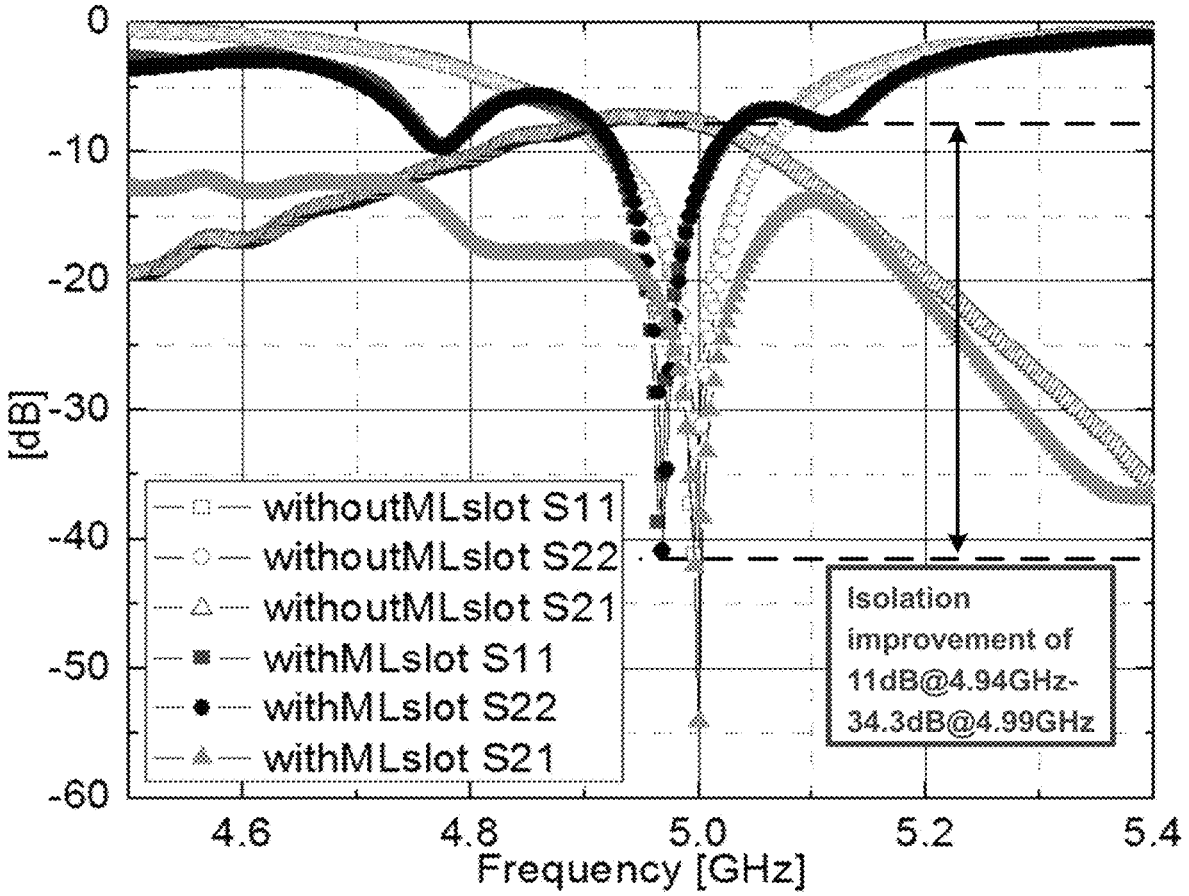
FIG. 6 is a plot illustrating measured S11, S21 and S22 of the fabricated antenna array of FIGS. 4A and 4B, in accordance with various embodiments of the present disclosure.

FIG. 6 shows a plot of measured S11, S21 and S22 of the fabricated 2×1 antenna array. A mutual coupling reduction of 11 dB (min.) to 34.3 dB (max.) was achieved for a WLAN application (4.94 GHz-4.99 GHz). A gap distance (d in FIG. 1A) of $0.06\lambda_g$ between the two antenna elements 106 was demonstrated, which is one of the smallest distances ever reported. Gap distances of less than $0.1\lambda_g$, where $\lambda_g$ is a guided wavelength of the excitation frequency of the antenna array. The PSC-ML architecture is frequency scalable. The number of the meander turns can be increased to further reduce the slot size and distance between the array elements 106. FIG. 7 is a table comparing the performance of the PSC-ML slots 106 with other published methods for reducing mutual coupling. As illustrated by the table of FIG. 7, the proposed PSC-ML slots 106 offer the smallest pitch size with an improvement of 40 dB isolation and no frequency shift.

In some embodiments, a tunable capacitor can be included between the two distal ends of the multiply folded sections 121. Using the tunable capacitor, the antenna performance can be tuned and used for beamforming applications. A tunable capacitor provides the capability to change the resonance frequency of the PSC-ML unit, which will serve as a switch or a modulator. For example, by applying a DC bias voltage between a tunable capacitor, the capacitance can be changed. For DC biasing circuits, the PSC-ML slots 106 can be segmented. In an array antenna, each patch can be operated to produce a constructive or destructive radiation pattern with its neighboring elements. The biasing voltage can be time modulated to realize beamforming functionality.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. An antenna array, comprising:

first and second patch antenna elements disposed on a first side of a substrate, the first and second patch antenna elements separated by a gap; and a meander line (ML) slot formed in a ground plane disposed on a second side of the substrate, the ML slot aligned with the gap between the first and second patch antenna elements, where the ML slot comprises two multiply folded sections extending from opposite ends of that ML slot towards a center point of that ML slot with opposite ends of the two multiply folded sections connected by a linear section extending between the opposite ends of the ML slot, and where distal ends of the two multiply folded sections are separated by a fixed distance.

2. The antenna array of claim 1, wherein a gap distance between the first and second patch antenna elements is less than $0.1\lambda_g$, where $\lambda_g$ is a guided wavelength of an excitation frequency of the antenna array.

3. The antenna array of claim 1, comprising a pair of ML slots aligned with the gap between the first and second patch antenna elements.

4. The antenna array of claim 3, wherein a length of the pair of ML slots is greater than a length of the gap.

5. The antenna array of claim 1, comprising a plurality of ML slots aligned with the gap between the first and second patch antenna elements.

6. The antenna array of claim 5, wherein the plurality of ML slots are separated by a fixed distance.

7. The antenna array of claim 1, comprising a tunable capacitor between the distal ends of the two multiply folded sections.

8. The antenna array of claim 1, comprising:

a plurality of patch antenna elements including the first and second patch antenna elements; and a plurality of ML slots disposed between adjacent patch antenna elements of the plurality of patch antenna elements.

9. The antenna array of claim 8, wherein the antenna array is a microstrip patch antenna comprising N patch antenna elements and N−1 ML slots.

10. The antenna array of claim 8, wherein at least one patch antenna element of the plurality of patch antenna elements has ML slots disposed along two adjacent sides of the at least one patch antenna element.

11. The antenna array of claim 8, wherein the antenna array is an N×M antenna array comprising the plurality of patch antenna elements.

12. The antenna array of claim 11, wherein N equals M.

13. The antenna array of claim 11, wherein at least one patch antenna element of the plurality of patch antenna elements has ML slots disposed along four sides of the at least one patch antenna element.

14. A method, comprising:

forming first and second antenna elements on a first side of a substrate, the first and second antenna elements separated by a gap; and forming a meander line (ML) slot in a ground plane disposed on a second side of the substrate, the ML slot aligned with the gap between the first and second antenna elements, where the ML slot comprises two multiply folded sections extending from opposite ends of that ML slot towards a center point of that ML slot with opposite ends of the two multiply folded sections connected by a linear section extending between the opposite ends of the ML slot, and where distal ends of the two multiply folded sections are separated by a fixed distance.

15. The method of claim 14, wherein forming the ML slot in the ground plane comprises:

disposing the ground plane on the second side of the substrate by electroplating; and forming the ML slot in the ground plane by etching.

16. The method of claim 15, further comprising patterning photoresist on the second side of the substrate prior to disposing the ground plane, the patterned photoresist defining the ML slot.

17. The method of claim 14, comprising:

forming a third antenna element on the first side of the substrate, the third antenna element separated from the second antenna element by a second gap; and forming a second ML slot in the ground plane aligned with the second gap between the third and second antenna elements.

18. The method of claim 17, comprising:

forming a fourth antenna element on the first side of the substrate, the fourth antenna element separated from the first antenna element by a third gap and separated from the third antenna element by a fourth gap; and forming a third ML slot in the ground plane aligned with the third gap between the fourth and first antenna elements and a fourth ML slot aligned with the fourth gap between the fourth and third antenna elements.

19. The method of claim 14, comprising forming a second ML slot in the ground plane aligned with the gap between the first and second antenna elements.

20. The method of claim 14, wherein the distal ends of the two multiply folded sections are connected to a tunable capacitor.

* * * * *